US006048072A

United States Patent [19]

Yen

[11] Patent Number: 6,048,072

[45] Date of Patent: Apr. 11, 2000

[54] BULB HOLDER HAVING DRAINING APERTURES

[76] Inventor: Chun Chang Yen, No. 8 Lane 247, Neu Pu Road, Hsinchu, Taiwan

[21] Appl. No.: 09/059,540

[22] Filed: Apr. 14, 1998

[51] Int. Cl.[7] ..... H01R 33/965

[52] U.S. Cl. ..... 362/96; 362/226; 439/190

[58] Field of Search ..... 362/96, 226, 227, 362/249, 294; 439/190, 191, 194, 206

[56] References Cited

U.S. PATENT DOCUMENTS

| | | | |
|---|---|---|---|
| 771,916 | 10/1904 | Moffitt | 439/190 |
| 2,226,292 | 12/1940 | Weston | 439/190 |
| 4,159,157 | 6/1979 | Koehler | 439/194 |
| 5,605,395 | 2/1997 | Peng | 362/226 |
| 5,707,138 | 1/1998 | Pan | 362/226 |

*Primary Examiner*—Alan Cariaso
*Attorney, Agent, or Firm*—Rosenberg, Klein & Lee

[57] ABSTRACT

This invention relates to a bulb holder of a light string, which is capable of receiving a base accompanying with a bulb and being provided a pair of apertures, which formed at both sides of the bulb holder to communicate the inner space of the holder with outside and to facilitate the draining effect of leaked water.

1 Claim, 4 Drawing Sheets

BULB HOLDER HAVING DRAINING APERTURES

BACKGROUND OF THE INVENTION

An outdoor used light string is always provided with its bulb holders having an effect of being waterproof or being capable of draining water, if leaking therein. In prior art, a known bulb holder has a pair of draining passages, which are positioned at both sides in the holder. Since these two passages are very small, the leaked water will not be easily drained out because of surface tension. The draining effect is limited.

OBJECT OF THE INVENTION

The main object of the present invention is to provide a bulb bolder of a light string, which is formed with two apertures on both sides relating to the two passages. The apertures can change the inner pressure and facilitates the draining of leaked water.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
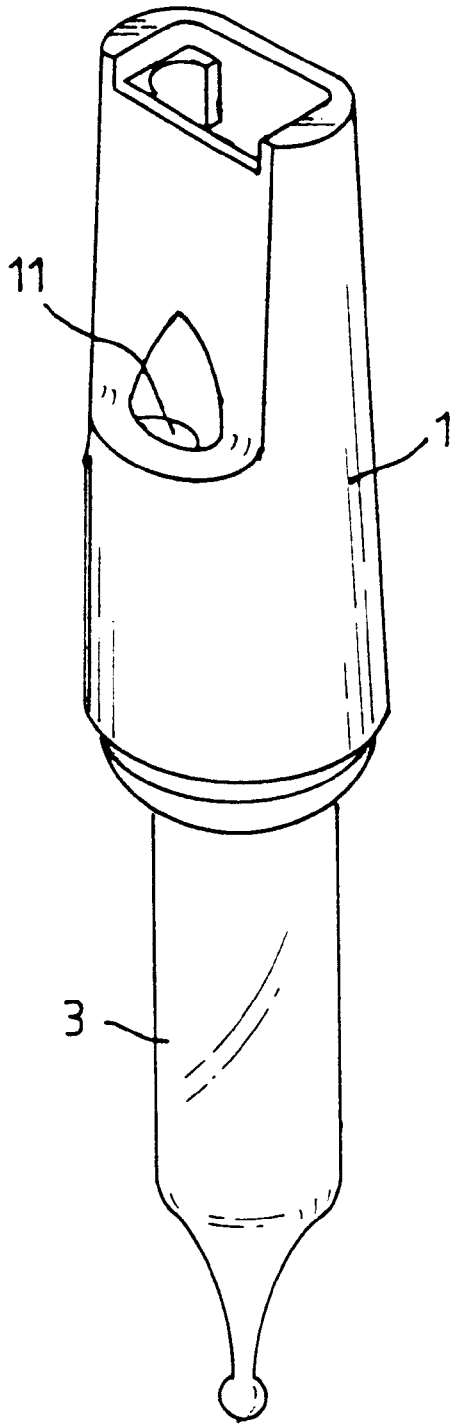
FIG. 1 is a perspective view showing a bulb holder according to the present invention.
Figure 2:
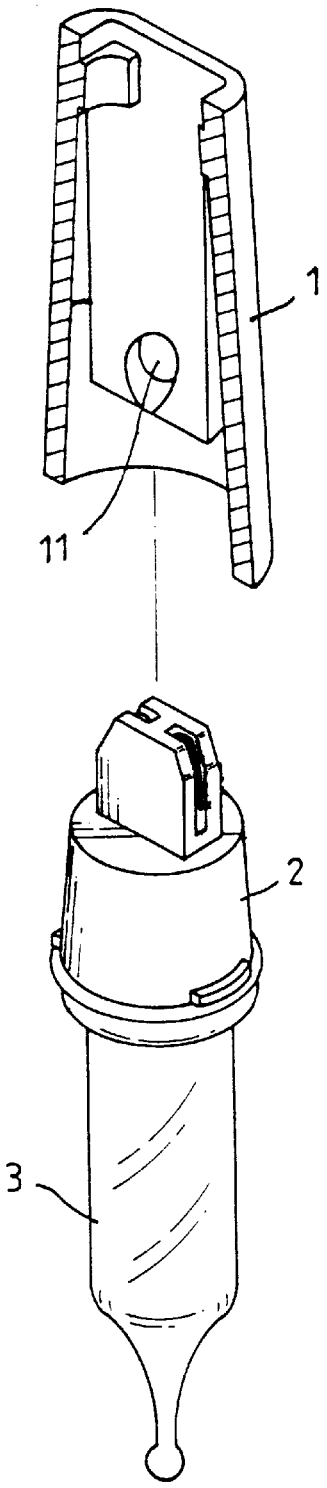
FIG. 2 is a perspective cross sectional view of the bulb holder with a bulb and a base of the present invention.
Figure 3:
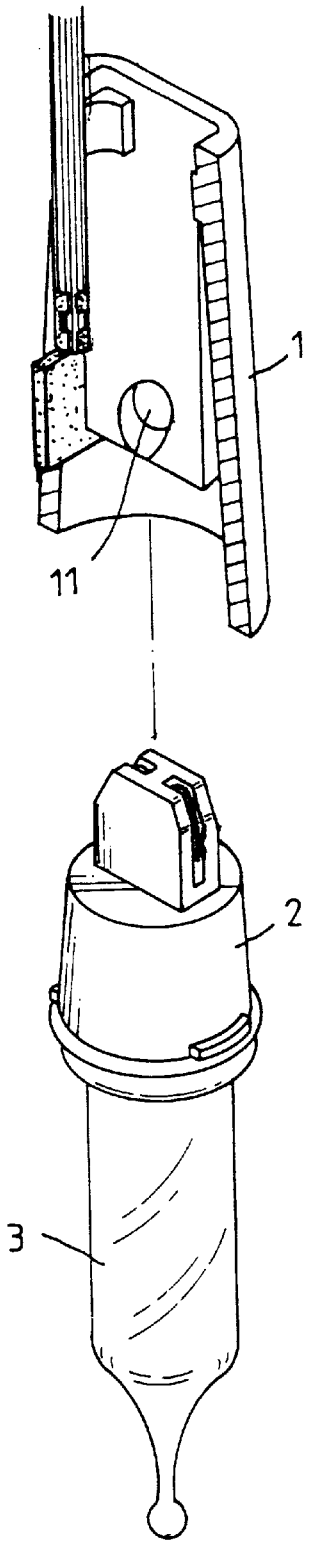
FIG. 3 is an assembled view of FIG. 3 with an electrical wire and a conductive plate.
Figure 4:
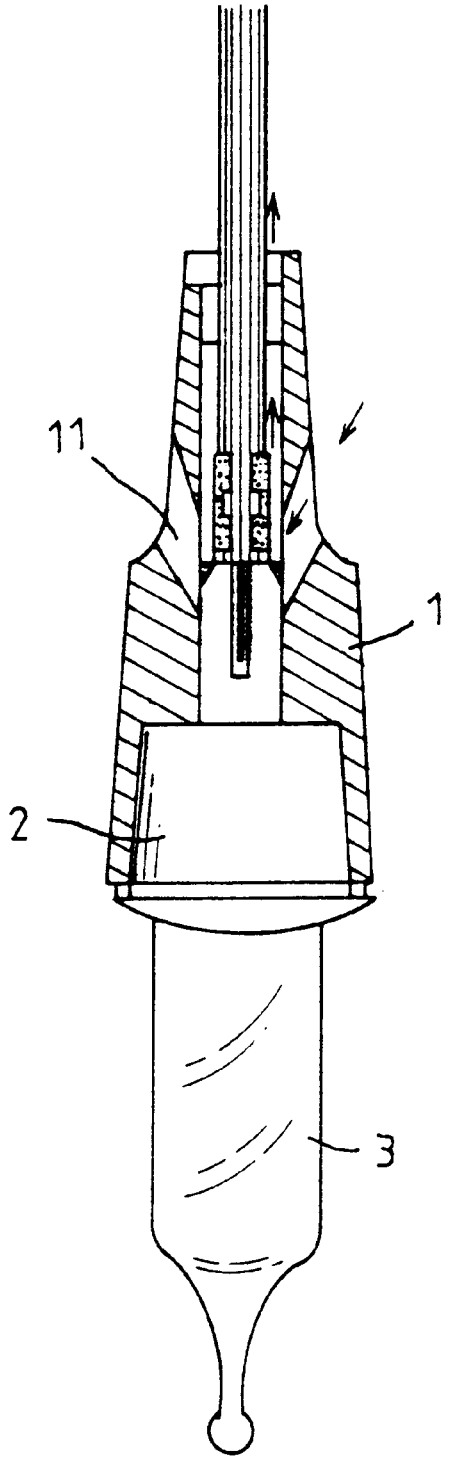
FIG. 4 is an assembled cross sectional view of FIG. 1 with the electrical wire and the conductive plate.

Please refer to FIGS. 1 to 4, the present invention mainly includes a bulb holder (1), a base (2), and a bulb (3) engaged in the base (2). The base (2) with the bulb (3) is then received within the bulb holder (1), as in the prior art. It is the most characteristic that a pair of apertures (11) are formed at both sides of the bulb holder (1). The inner space of the holder (1) is possibly communicated with outside. Under this structure, if water is leaked in the holder (1), the water can be drained out naturally because the air can flow through the apertures to change the pressure therein when the light string is hung and swung by the wind.

It is to be understood that in the bulb holder of the present invention use of the apertures allows air to pass through and change the inner pressure of the holder. So the leaked water can be drained very easily and quickly. It overcomes the drawback of the prior known one.

Accordingly, it can be found that the present invention obtains an obvious improvement and is different from any prior art. Thus, the present invention should be approved and allowed for patent.

I claim:

1. A holder for holding a lamp bulb comprising:

(a) a base for the lamp bulb;

(b) a first body portion extending longitudinally between first and second ends, said main body portion defining at said first end thereof a longitudinal bore for receiving the base of the lamp bulb; and, (c) a second body portion extending from said first body portion, said second body portion having formed therein at least one longitudinal drain passage communicating with said bore, said second portion having formed therein at least a pair of side apertures, each said side aperture defining an inclined passage communicating with said longitudinal drain passage for facilitating an exhaustive flow through said drain passage.

* * * * *